US006430821B1

(12) United States Patent
Cionni

(10) Patent No.: US 6,430,821 B1
(45) Date of Patent: Aug. 13, 2002

(54) GRAVITY BOW SIGHT

(76) Inventor: Jack C. Cionni, 127½ Brookview Dr., Follansbee, WV (US) 26037

( * ) Notice: Subject to any disclaimer, the term of this patent is extended or adjusted under 35 U.S.C. 154(b) by 0 days.

(21) Appl. No.: 09/570,993

(22) Filed: May 15, 2000

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS

| | | | | | |
|---|---|---|---|---|---|
| 3,013,336 | A | * | 12/1961 | Pennington | 33/265 |
| 3,271,863 | A | * | 9/1966 | Harrington | 33/265 |
| 3,477,130 | A | * | 11/1969 | Egan | 33/265 |
| 3,487,548 | A | * | 1/1970 | Frydenlund | 33/265 |
| 4,224,741 | A | * | 9/1980 | Perry | 33/265 |
| 4,580,349 | A | * | 4/1986 | Webb et al. | 33/265 |
| 4,616,422 | A | | 10/1986 | Gaddy | 33/265 |
| 4,974,328 | A | * | 12/1990 | Lowry | 33/265 |
| 5,092,052 | A | * | 3/1992 | Godsey | 33/265 |
| 5,305,530 | A | | 4/1994 | Robertson, Jr. et al. | 33/265 |
| 5,347,722 | A | | 9/1994 | Sefsick | 33/265 |
| 5,388,336 | A | | 2/1995 | Pomaville | 33/265 |
| 5,561,910 | A | | 10/1996 | Maynard | 124/87 |
| 5,651,185 | A | * | 7/1997 | Vanderheyden et al. | 33/265 |
| 5,718,215 | A | * | 2/1998 | Kenny et al. | 124/87 |
| 6,145,208 | A | * | 11/2000 | Savage | 33/265 |
| 6,276,068 | B1 | * | 8/2001 | Sheliga | 33/265 |

* cited by examiner

*Primary Examiner*—G. Bradley Bennett
(74) *Attorney, Agent, or Firm*—Renner, Otto, Boisselle & Sklar, LLP

(57) ABSTRACT

A bow sight includes a balancing disk from which an adjustable sight bracket projects forwardly. The bracket may be angularly adjustably secured to the disk through an arcuate slot and clamp. An eccentric weight keeps the disk in a gravity oriented position. The end of the sight bracket supports a transversely adjustable sight pin which includes on its end a front sight bead. The bow sight is supported between parallel plates mounted on the bow and includes a forwardly projecting brush guard and a locking lever may be employed to lock the disk during movement or transportation to prevent damage or misalignment. When the sight is bore sighted and adjusted on level ground at a distance of about 20 yards, for example, the balancing disk will maintain the disk and sight in a level position throughout the movement of the bow, and will provide the proper elevation for the front sight bead whether shooting uphill or downhill.

11 Claims, 5 Drawing Sheets

GRAVITY BOW SIGHT

DISCLOSURE

This invention relates generally as indicated to a gravity bow sight, and more particularly to a bow sight of simplified construction which when bore sighted at a level distance and adjusted will provide the proper elevation for shooting uphill or downhill.

BACKGROUND OF THE INVENTION

A number of pendulum sighting mechanisms have been developed for the bow and arrow and usually involve a weighted arm hanging from a pivot at or near the top. A sight is adjustably mounted on the arm. Such sights usually involve a multiplicity of adjustments as well as fixed adjustable sights not pendulum mounted. The stability of such pendulums is such that it is difficult to adjust a sight with respect to the pendulum, either for elevation or azimuth. Moreover, the fixed sights interfere with the pendulum sights and form a complexity of adjustments that are hard to make in the field. Examples of such sights are seen in prior U.S. Pat. Nos. 4,616,422, 5,388,336, and 5,347,722.

A more simplified pendulum sight is seen in prior U.S. Pat. No. 5,305,530. This patent discloses a weight balanced forward projecting substantial arm with two sights substantially spaced along the arm. Like the sight of U.S. Pat. No. 4,616,422, it is designed for use from an elevated site, such as a tree stand. The primary adjustment is of the weight itself through a threaded rod projecting from the rear extension of the arm.

Another example of complex sighting mechanisms is seen in U.S. Pat. No. 5,561,910. This patent uses a pendulum pin riding in a complex cam slot which in at least one embodiment is itself pendulum pivoted. The cam slot controls the vertical position of a horizontal sighting element with respect to a vertical sighting element. The primary field adjustment would appear to be the remedial action required when the pendulum pin sight hangs up in the pendulum slot.

It would accordingly be desirable to have a simplified bow sight which could easily be adjusted in the field and which would provide accurate positioning of the front sight whether shooting at an elevated, depressed or substantially level target.

SUMMARY OF THE INVENTION

A front bow sight is mounted between a parallel plate housing which is mounted on the bow with the usual bow sight mounting bracket. A weighted disk is pivoted between the plates and a forwardly projecting sight bracket is mounted on the disk. The bracket is pivotally adjusted on the axle of the disk and an arcuate slot at the rear permits the bracket to be clamped to the disk at an adjustable radial direction from the center of the disk. A laterally extending and laterally adjustable sight pin on the projecting end of the sight bracket includes a front sight bead. The sight pin is adjustable transversely of the sight bracket for windage. A locking lever is included on the housing to fix the disk when transporting the bow. A forwardly projecting brush guard also extends from the housing.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
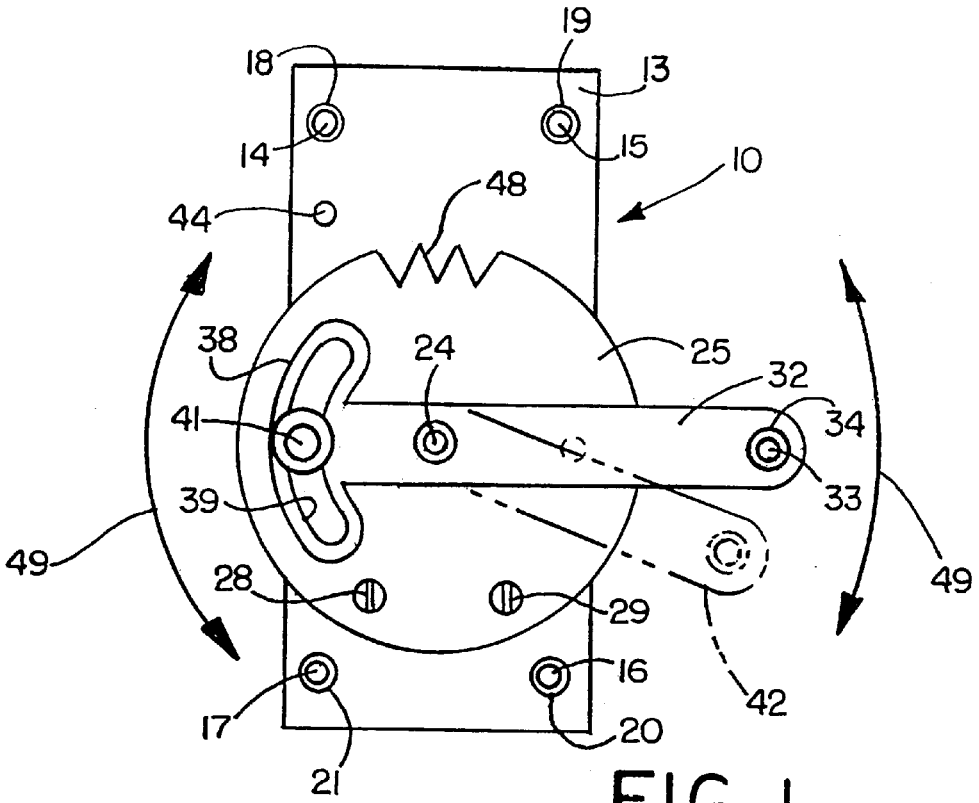
FIG. 1 is a vertical section through the housing illustrating the disk and the adjustment of the forwardly projecting sight bracket.
Figure 2:
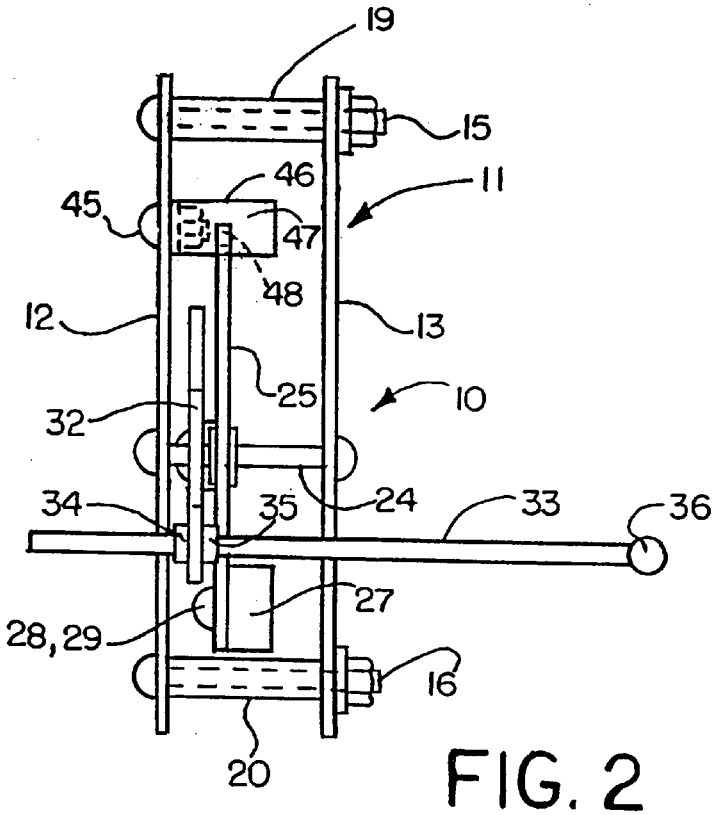
FIG. 2 is an elevation of the housing as seen from right hand side of FIG. 1 with the sight pin depressed for clarity of illustration.

Referring initially to FIGS. 1 and 2, it will be seen that the bow sight shown generally at 10 includes a frame 11 formed by parallel plates 12 and 13. The plates are held parallel to each other by the nut and bolt assemblies seen at 14, 15, 16 and 17 which extend through tubular spacers 18, 19, 20 and 21, respectively. In this manner the two plates are both held together and maintained parallel.

Also extending through the middle of the frame is an axle 24 supporting balancing disk 25 for rotation or swinging movement. A weight shown at 27 is secured to the balancing disk by fasteners 28 and 29. Also mounted on the axle 24 is a sight bracket shown generally at 32. The sight bracket projects forwardly of the balancing disk and at its projecting end supports a transversely extending sight pin 33. The sight pin may extend through a lock or collet nut 34 and a tapered thread form 35 receiving the nut at the projecting end of the sight bracket. The transversely projecting end of the sight pin is provided with a sight bead seen at 36. The rear of the sight bracket is provided with an arcuate symmetrical transverse extension seen at 38 which includes an arcuate slot 39. A clamp screw shown at 41 extends through the slot and may be threaded into the balancing disk so that tightening or loosening of the clamp screw permits the sight bracket 32 to be adjusted with respect to the balancing disk. The sight bracket is pivoted about the axle 24 which is also the pivot of the balancing disk, and may be adjusted about the axle as indicated by the phantom position 42 of the sight bracket seen in FIG. 1. The sight bracket may also be mounted on the opposite side of the disk with the sight pin 33 projecting to the left as seen in FIG. 2 for a left-handed archer.

Figure 3:
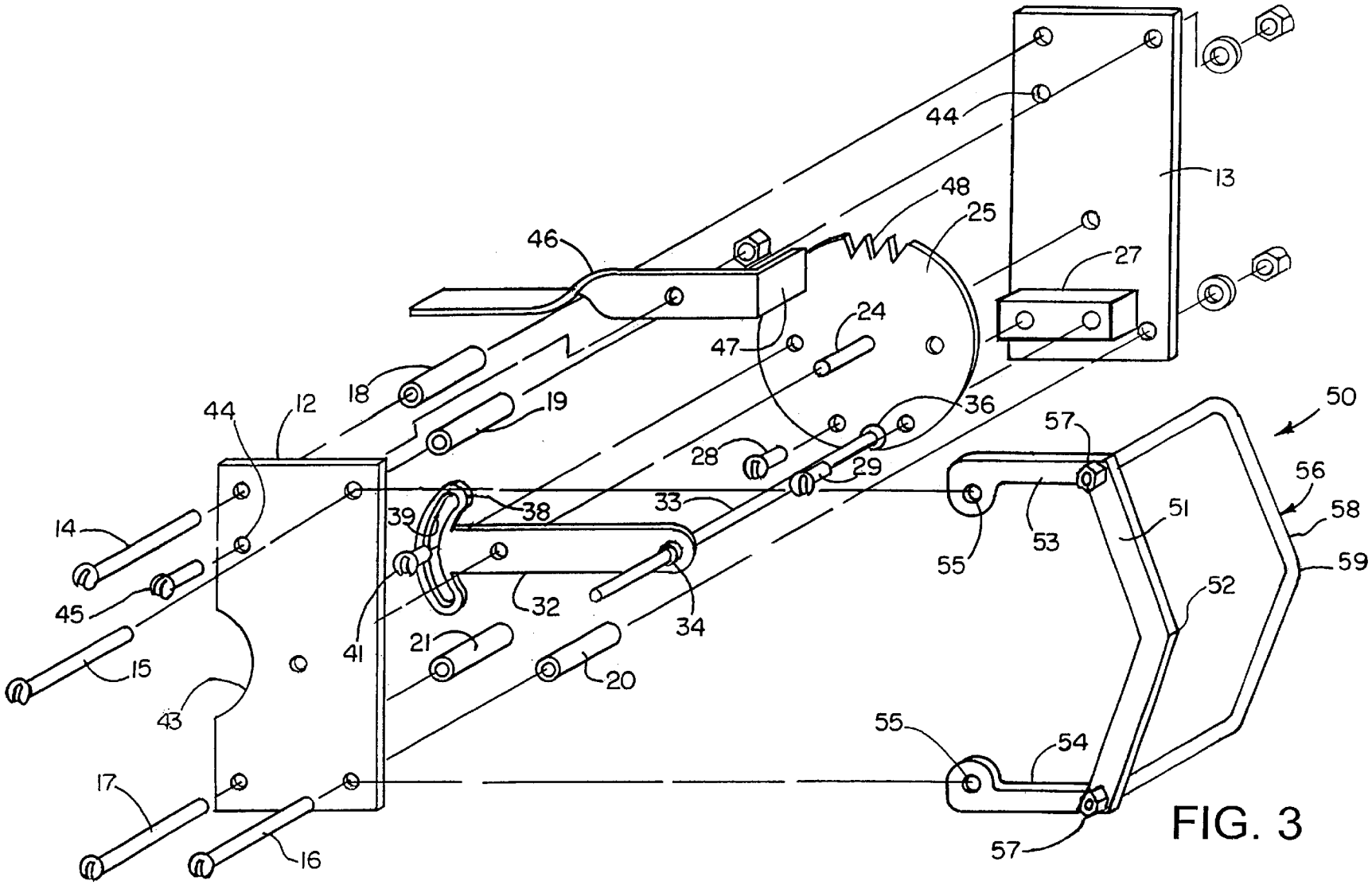
FIG. 3 is an exploded view of the assembly showing the various components.

As seen more clearly in FIG. 3, the plate 12 may be provided with a clearance indicated at 43 permitting lateral access to the clamp screw 41. The plate 12 may also have an additional hole indicated at 44 below the top which may receive the nut and bolt assembly shown at 45 pivotably supporting locking lever 46. The locking lever includes a right angle projecting portion indicated at 47 adapted in one position of the lever to engage the notches,48 in balancing disk 25 and hold it stationary when clamped. This precludes the disk-sight bracket assembly from the normal free balancing movement indicated by the arcuate arrows 49 in FIG. 1. The projecting end of the locking lever may be twisted 90° to provide a more convenient handle. The hole 44 in the opposite plate permits the lever to be mounted on either plate for right or left hand operation.

Also as seen more clearly in FIG. 3, the sight assembly may be provided with a brush guard shown generally at 50 which includes a side frame 51, the front edge of which projects forwardly at the center as indicated at 52. Legs 53 and 54 include inwardly offset eyes 55 on the projecting ends so that the brush guard may be mounted on the frame utilizing the bolt assemblies 15 and 16 extending through the corresponding holes in the side plate 12. The brush guard frame is completed by a laterally projecting bail 56 held to the side frame by fasteners 57 at the ends of the legs of the bail. The bight portion 58 includes a projecting center 59 corresponding to the side frame projection 52. The projecting frame acts as a barrier to protect the balancing disk and sight bracket as well as the sight pin from contact with brush, tree branches, or other solid objects, for example, while hunting or traveling.

With the simplified construction the front sight assembly as illustrated in FIGS. 1 through 3 may readily be mounted on the conventional bow sight bracket found on most bows. In this manner the sight frame is aligned with and attached to the vertical member of the bow.

Figure 4:
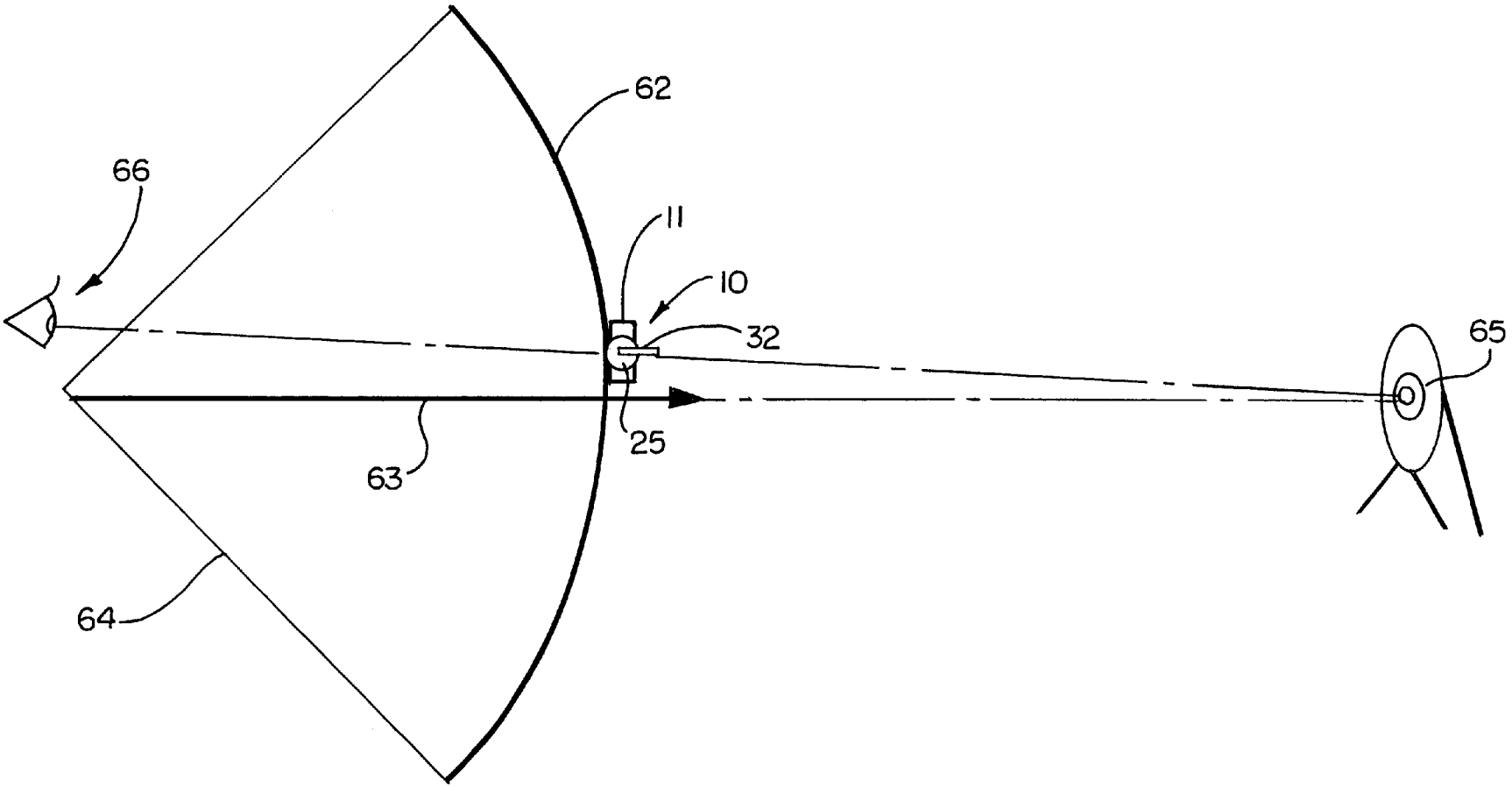
FIG. 4 is a schematic view of the sight in use with a level shot.
Figure 5:
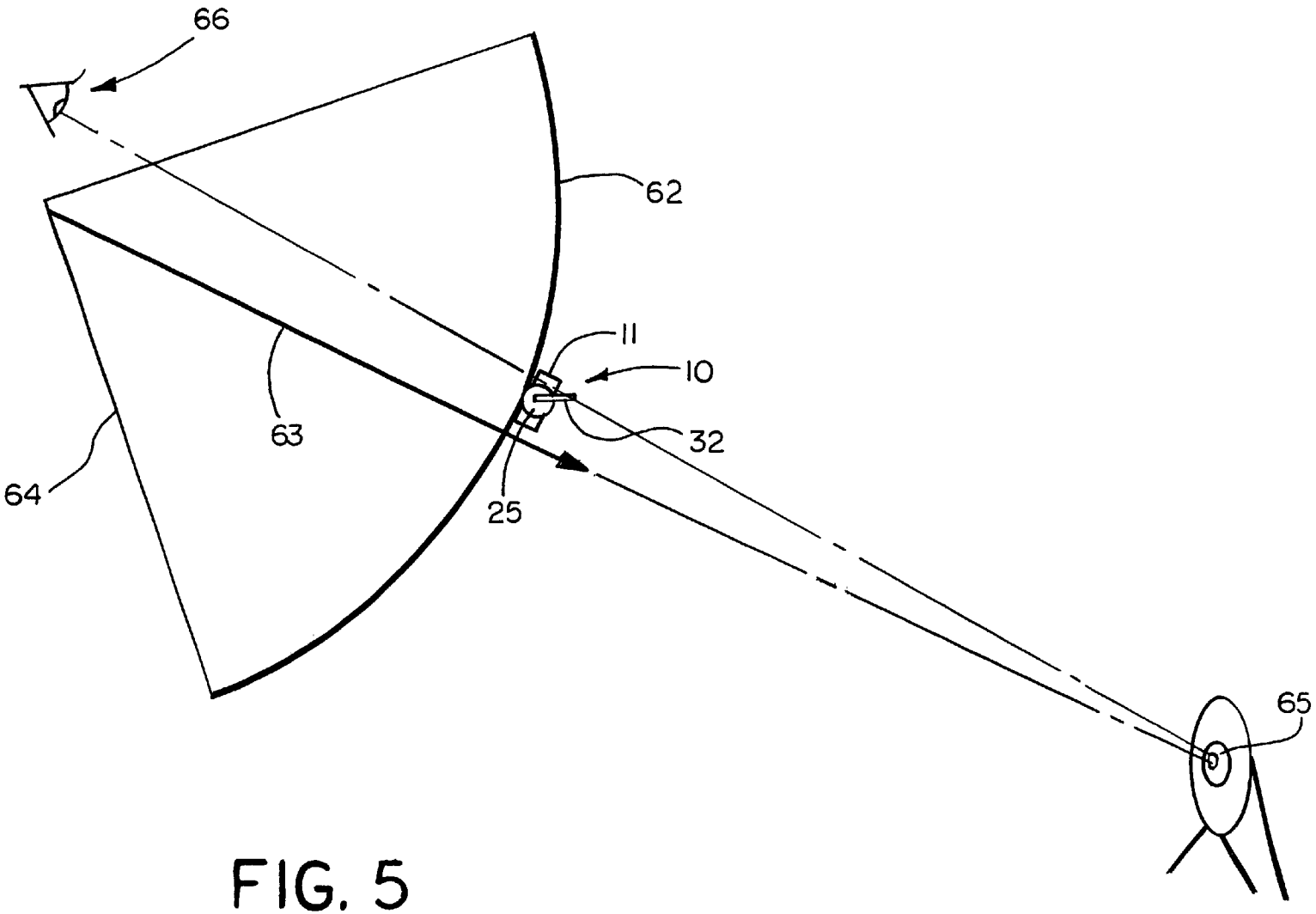
FIG. 5 is a similar schematic view with the sight in use with a downhill shot.
Figure 6:
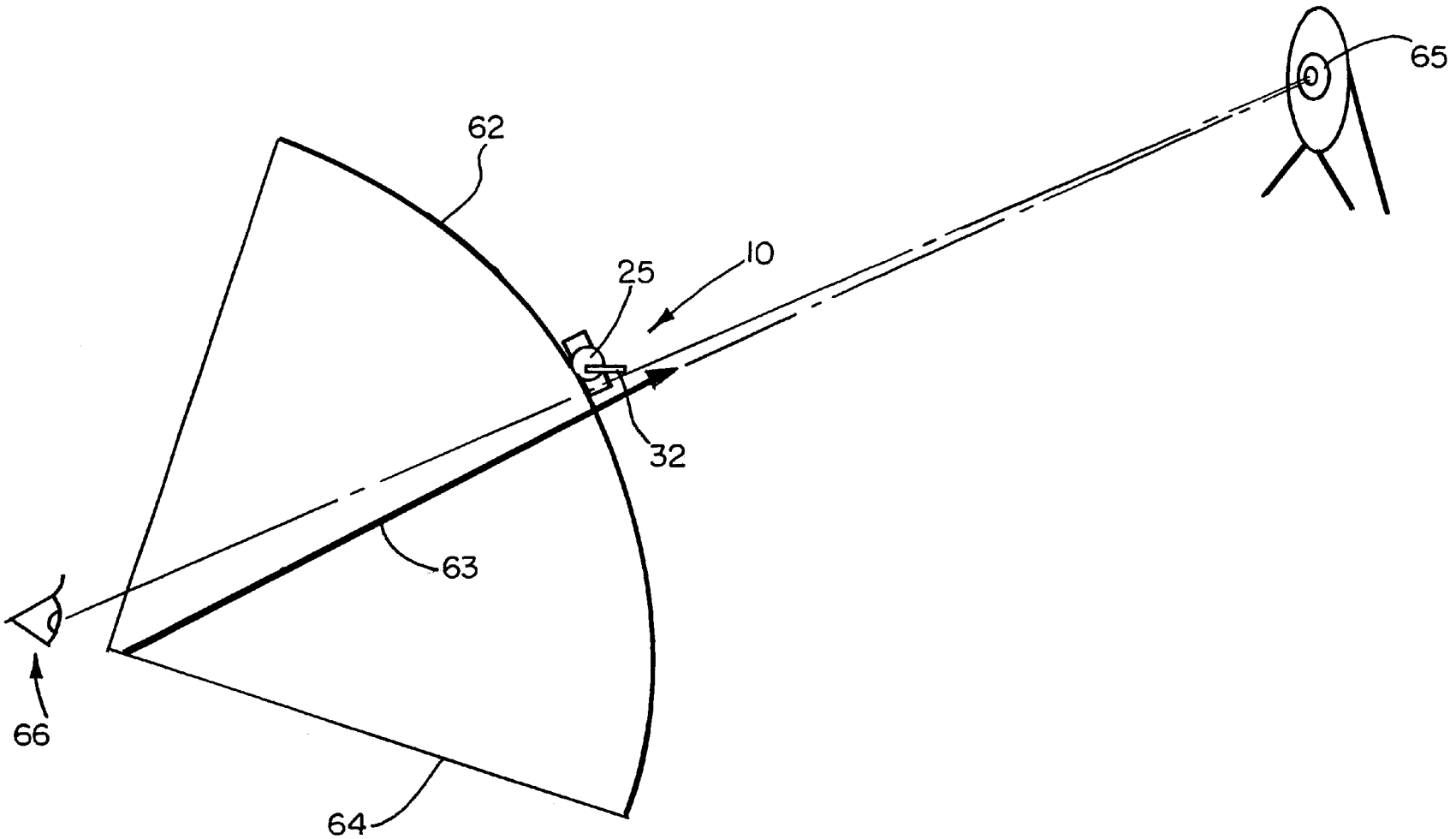
FIG. 6 is a similar schematic view with the sight in use with an uphill shot.

Referring now to FIGS. 4, 5 and 6, the bow is illustrated at 62, the arrow at 63, the bow string at 64, and the target at 65. The eye of the archer is indicated at 66 normally aligning a rear peep sight slightly above the arrow 63 with the front sight bead 36 on the end of sight pin 33 extending from the end of sight bracket 32.

It will now be seen that the sight contains a weighted balancing disk that maintains the same position regardless of the angle that the shooter holds the bow. The balancing disk, along with it sight bracket, pivots freely on its axle or axis as indicated by the arrows 49 in FIG. 1. The weight at the bottom of the disk keeps the disk hanging in the same position whether the bow points uphill, level, or downhill. This action keep the sight bracket with its sight pin horizontal at all times as seen in comparing FIGS. 4 through 6. When aiming at the target, the bow's movement relative to the sight pin gives the shooter the illusion that the sight pin is moving up or down during the aiming procedure.

Referring initially to FIG. 4, when adjusting the sight for elevation, the shooter must normally be on level ground as illustrated, approximately 20 yards from the target 65. There the shooter first places an arrow 62 on the bow and draws back the bow string 64 to the full draw while aligning the sight pin on the center bulls eye. The arrow is then shot at the target. If the point of impact of the arrow is high or low, the sight bracket clamp screw 41 is loosened and the sight bracket is adjusted to raise or lower the pin in the same direction as the arrows impact relative to the bulls eye. For example, if the point of impact of the arrow is at the top of the target, the shooter then adjusts the sight pin bracket so that the sight pin or sight bead is elevated. This will then lower the arrows point of impact closer to the center of the target. This bore sighting adjustment is done by trail and error until the shooter hits the target substantially dead center. As indicated, this adjustment is normally done at approximately 20 yards and on level ground.

When the point of impact is to the left or the right of the target, windage adjustments may be made. The windage adjustment is done in a similar manner as the elevation adjustment except that the sight pin is adjusted right or left. For example, if the point of impact of the arrow hits to the left of the target, the shooter adjusts the sight pin in the direction of the arrows point of impact relative to the bulls eye. This will move the subsequent point of impact toward the center of the target. This is also done by trail and error until the shooter has sighted in the sight to shoot accurately. The left or right hand movement of the sight bead on the end of the sight pin is accomplished simply by loosening the lock nut 34 and adjusting the sight pin transversely on the sight bracket.

When adjusted, the bow will shoot accurately within a range corresponding to the draw weight of the bow. To verify this distance the shooter should shoot at the target from several distances while placing the sight pin on the bulls eye. The shooter should normally begin at about 20 yards, and move further away until the arrows point of impact hits low on the bulls eye.

This distance from the shooter to the target at this point is the maximum yardage that the bow will shoot accurately with its current draw weight setting. A bow having a draw weight of 60 pounds, for example, will have a greater accuracy range of than a bow with a draw weight of 45 pounds. If the bow's draw weight is ever changed, the sight will normally require recalibration following the procedure outlined above.

Elevation and windage adjustments may be made concurrently. Once these adjustments are complete, no further adjustments are needed. A shooter will be able to shoot accurately at a target or a wild game downwardly from a tree stand, for example as seen in FIG. 5, uphill as seen in FIG. 6, and on substantially level ground as seen in FIG. 3, all within the bows shooting range. When comparing FIGS. 5 and 6, it will be seen that the sight bracket 32 remains level regardless of the angle of inclination of the bow and arrow elevating the front sight slightly as in FIG. 5 and depressing the front sight slightly as in FIG. 6 from the aiming path for the downhill and uphill shots, respectively.

It can now be seen that there is provided a simplified bow sight mounted in a parallel plate frame mounted on the bow with a weighted balancing disk supported by the frame adjustably supporting a forwardly projecting sight bracket which in turns mounts a laterally adjustable sight pin. Once the adjustments are made the balancing disk keeps the sight bracket with its sight pin substantially horizontal at all times whether shooting on the level, uphill, or downhill. When aiming at a target the bows movement relative to the sight pin gives the shooter the illusion that the sight pin moves up or down during the aiming procedure.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only be the scope of the claims.

What is claimed is:

1. A bow sight comprising a frame adapted to be mounted on a bow, a weighted disk supported by said frame for swinging movement about a horizontal axis, a forwardly projecting sight bracket on said disk, a front sight mounted on the end of said sight bracket, and means to adjust the position of said sight bracket with respect to said disk, and to clamp the bracket and disk together in adjusted position.

2. A bow sight as set forth in claim 1, including an arcuate slot in said sight bracket, and a clamp fitting in said slot to clamp the bracket and disk together.

3. A bow sight as set forth in claim 1, including a transversely adjustable sight pin mounted on the front of said sight bracket.

4. A bow sight as set forth in claim 1, including parallel plates forming said frame, and an axle for said disk forming said axis extending between said plates.

5. A bow sight as set forth in claim 1, including a brush guard projecting forwardly of said frame to protect said bow sight.

6. A bow sight as set forth in claim 1, including a locking lever pivoted to said frame, in one position clearing said disk, and in another position engaging the disk to keep it from movement during travel.

7. A bow sight as set forth in claim 1, including an adjustment slot on the rear of said sight bracket straddling a clamp on said disk operative to permit adjustment of the sight bracket with respect to said disk and to clamp the sight bracket in adjusted position.

8. A bow sight comprising a frame, a balancing disk pivoted on said frame, a sight bracket adjustably mounted on said disk, a sight pin mounted on said sight bracket, so that when said sight pin is bore sighted for a generally level target, and the disk-sight bracket adjustment made, the sight pin will automatically depress and elevate for uphill and downhill shots, respectively.

9. A bow sight as set forth in claim 8, including means to adjust said sight pin with respect to said sight bracket for windage.

10. A bow sight as set forth in claim 8, including a locking lever on said frame to immobilize said disk during travel.

11. A bow sight as set forth in claim 8, including a brush guard projecting forwardly from said frame.

* * * * *